US010071835B1

(12) United States Patent
Reid

(10) Patent No.: US 10,071,835 B1
(45) Date of Patent: Sep. 11, 2018

(54) STACKABLE MOLDED CAP

(75) Inventor: Grahame W. Reid, Sebastapol, CA (US)

(73) Assignee: RIEKE CORPORATION, Auburn, IN (US)

( * ) Notice: Subject to any disclaimer, the term of this patent is extended or adjusted under 35 U.S.C. 154(b) by 0 days.

(21) Appl. No.: 10/985,562

(22) Filed: Nov. 10, 2004

(51) Int. Cl.
*B65D 41/04* (2006.01)

(52) U.S. Cl.
CPC ..... *B65D 41/04* (2013.01)

(58) Field of Classification Search
CPC ..... B65D 39/00; B65D 41/00; B65D 41/005; B65D 41/04; B65D 1/023; B65D 51/18; B65D 1/0246; B65D 1/0223; B65D 41/0428; B65D 41/045; B65D 41/3442
USPC ..... 220/288, 380; 215/329, 240, 356; 206/505, 508, 515, 516, 503, 504
See application file for complete search history.

(56) References Cited

U.S. PATENT DOCUMENTS

| | | | | | |
|---|---|---|---|---|---|
| 2,117,296 | A * | 5/1938 | Cahoon | 222/153.13 | |
| 2,647,652 | A * | 8/1953 | Sanford | 215/337 | |
| 2,934,232 | A * | 4/1960 | Pesch et al. | 215/321 | |
| 3,438,530 | A * | 4/1969 | Wallace | 215/329 | |
| 3,447,714 | A | 6/1969 | Elliot | | |
| 3,480,177 | A | 11/1969 | Elliot | | |
| 3,648,874 | A * | 3/1972 | Moller | 215/252 | |
| 4,066,180 | A * | 1/1978 | Sanchez | B65D 41/52 215/254 | |
| 4,202,456 | A * | 5/1980 | Silber | 215/228 | |
| 4,322,010 | A * | 3/1982 | Curry | 215/256 | |
| 4,347,943 | A * | 9/1982 | Hackwell et al. | 220/792 | |
| 4,360,114 | A * | 11/1982 | Owens | 215/329 | |
| 4,494,668 | A * | 1/1985 | Lottick | 220/709 | |
| 4,723,685 | A * | 2/1988 | Fillmore et al. | 220/288 | |
| 5,788,101 | A * | 8/1998 | King | 215/349 | |
| 5,971,183 | A * | 10/1999 | Bartsch | 215/256 | |
| D427,070 | S * | 6/2000 | Brozell | D9/453 | |
| 6,371,317 | B1 * | 4/2002 | Krueger | 215/252 | |
| 6,439,412 | B2 * | 8/2002 | Luch | 215/318 | |
| 6,454,118 | B1 * | 9/2002 | D'Amato | 220/380 | |
| D481,314 | S * | 10/2003 | Noonan | D9/438 | |
| 6,685,049 | B1 * | 2/2004 | Paladino | 220/781 | |
| 2004/0040928 | A1 * | 3/2004 | Noonan | 215/252 | |
| 2004/0045926 | A1 * | 3/2004 | Williamson | 215/252 | |

FOREIGN PATENT DOCUMENTS

| | | | | |
|---|---|---|---|---|
| EP | 0119055 | A2 * | 9/1984 | |
| JP | 09315452 | A * | 12/1997 | B65D 41/34 |

* cited by examiner

*Primary Examiner* — Ernesto Grano
(74) *Attorney, Agent, or Firm* — McDonald Hopkins LLC

(57) ABSTRACT

An injection molded plastic closure, stackable with similar closures in a known manner to prevent warping during cooling and to increase box storage capacity, is formed with a lead-in taper at the bottom of the closure skirt, maintaining and enhancing the stacking function while greatly reducing and nearly eliminating problems of cross-threading when the closure is screwed onto a container by machinery during a capping operation.

15 Claims, 3 Drawing Sheets

STACKABLE MOLDED CAP

BACKGROUND OF THE INVENTION

This invention concerns injection molded closure caps and particularly such closure caps which address the problem of warping during post-molding curing.

In the interests of economy, injection molded plastic caps have been reduced in thickness and weight. A 110 mm cap (110-400), for example, can have a weight of less than about 18 grams, including the cap seal. One effect is that the top disk or panel becomes even more prone to warping during cooling and curing of the cap after molding, a process that can take about 24 hours. Warping can be induced by storing the just-molded closures in a container in random arrangement. This puts warping forces against the molded closures during curing, particularly those near the bottom of a bin or case. As a result, problems are encountered during automated assembly of the threaded closure cap onto a container.

A solution to this problem was devised by the assignee of the present invention, and has been used for several years. This solution has been to stack the caps coaxially, forming stacks or "logs" of caps by spinning each cap as it emerges from the mold, allowing them to "walk" along rotating rods to settle into a coaxially stacked log. In this way, all of the closures in a stack or log of caps are maintained in the proper shape during the curing period. Caps can be made lighter and thinner as a result of this log stacking process. Closure caps produced for such handling and stacking have included a nesting recess in the skirt of the closure, enabling the top of one cap to nest within the bottom edge of the skirt of a succeeding cap, resting on a ledge in the recess. Another benefit of stacking is compact storage, allowing more caps to a shipping case.

Although the stacking feature on the described caps, which included large 110 mm caps, worked well, the closures sometimes tended to cross-thread when screwed onto a container neck, especially in an assembly line capping operation in which containers were filled and closed. This caused an unacceptable rejection rate in the filling/assembly process. The configuration of the cylindrical recess for nesting the top of the succeeding cap tended to allow the cap to catch on the bottle finish and to become canted and this led to occasional cross-threading. This problem is related to the "S" dimension, which is defined as the dimension from the bottom of the cap's skirt up to the bottom of the thread start. In the case of the subject cap with the cross-threading problems, there were in essence two "S" dimensions: the distance from the skirt bottom up to the rim or ledge; and the distance from the ledge to the thread start. This simply provided too great an opportunity for canting and cross-threading, since the ledge at one side could catch on the bottle finish during cap assembly.

SUMMARY OF THE INVENTION

This invention provides a solution to the above-described problem by eliminating the cap-nesting ledge on the interior of the skirt. Instead, the region below the thread start leads in with a taper, i.e. an annular section of a cone. This cone section or taper begins just a slight distance above the bottom of the skirt, at the point of largest diameter, and terminates at a smaller-diameter upper end which is essentially at the bottom of the thread start.

The external shoulder of the cap has a complementary bevel, configured to nest against the taper of an adjacent cap when the caps are stacked.

The injection molded lightweight closure cap of the invention is capable of being pushed axially down over the container thread or threads for an initial portion of the thread depth. In a capping operation, the cap is pushed down onto the container finish with a flat, horizontal "tongue". During this downward movement of the cap, essentially nothing is present to cause the cap to catch and cant, but even if this does occur to some extent, the taper may then contact the container finish, whereupon the taper slides along the container finish and tends to straighten the cap to the flat position for proper threading. If sufficient force is applied to the tongue, an initial portion of the thread can be caused to jump over the corresponding container thread until a wide band of cap thread rests on container thread, the two threads having the same helix angle and thus causing the cap to assume the flat horizontal position for proper threading. The ability to "jump" an initial portion of the thread is helped by the thinner wall of the cap, which is enabled because of the log stacking.

The invention can be applied to injection molded caps of virtually any size including 110 mm, 120 mm (or even larger), as well as smaller caps; the warping problem, and thus the need for stacking, is greater with the larger caps, but any caps that have the stacking recess are benefited.

It is among the objects of this invention to improve the geometry of stackable injection molded plastic closure caps, especially those of relatively large diameter but also including smaller-diameter caps, by greatly reducing or eliminating the tendency of a stacking closure to cross-thread during an automatic capping operation. These and other objects, advantages and features of the invention will be apparent from the following description of a preferred embodiment, considered along with the drawings.

DESCRIPTION OF PREFERRED EMBODIMENTS

Figure 1:
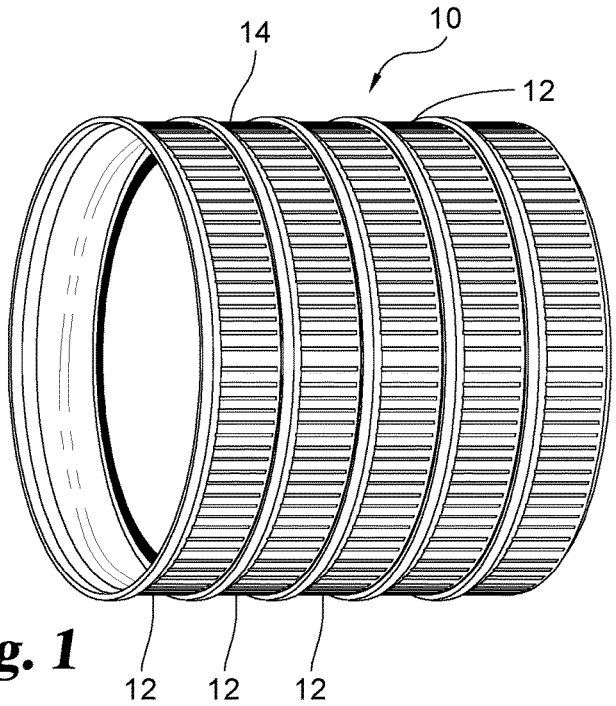
FIG. 1 is a perspective view showing a series of injection molded plastic caps stacked together into a "log" following molding.

In the drawings, FIG. 1 shows a "log" or stack 10 of injection molded closure caps 12, a stacked configuration which is useful in handling and storing the caps during the curing period, after molding, to prevent warp. This is especially true with thin, lightweight injection molded caps and particularly with caps of relatively large diameter, such as 110 mm and 120 mm but also for caps of smaller diameters. The caps 12 are nested together in an overlapping position in which the bottom edge of the skirt 14 of one cap overlaps the shoulder and upper edge of the skirt of the next cap.

Figure 2:
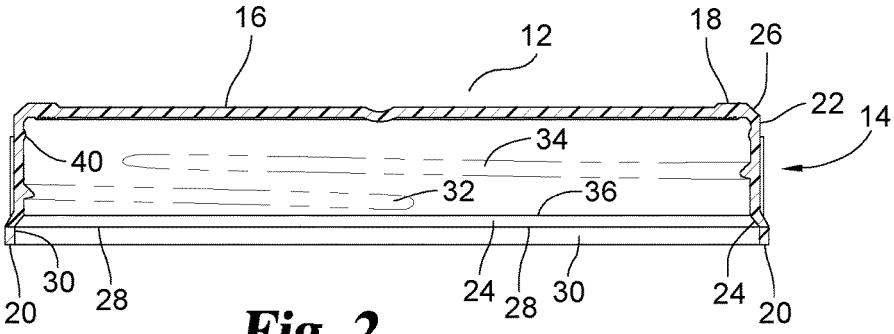
FIG. 2 is a sectional elevation view showing an embodiment of the cap of the invention.
Figure 3:
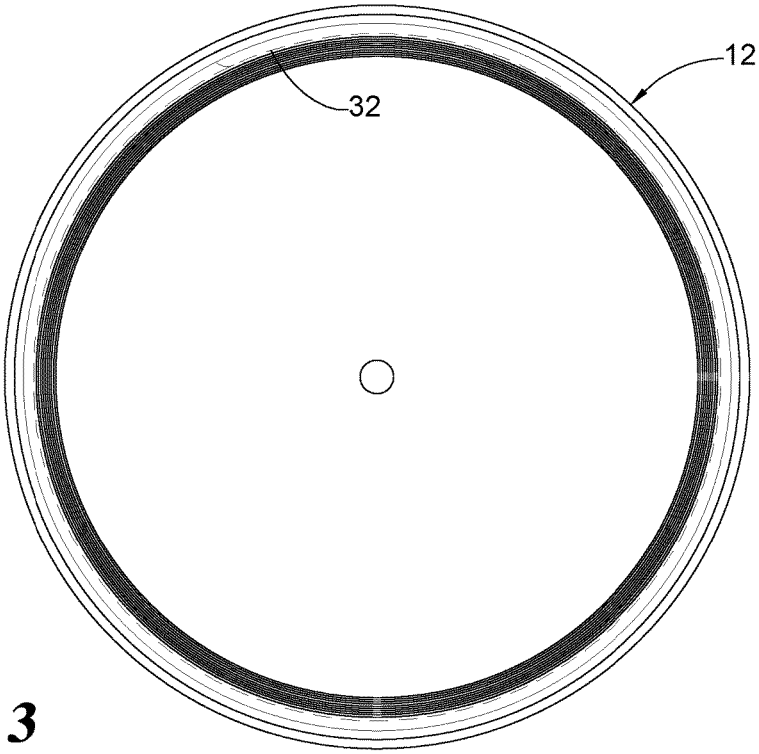
FIG. 3 is a top plan view of the cap of FIG. 2.

FIG. 2 shows a cap of the invention in a cross-sectional elevation view. FIG. 3 shows the cap 12 in top plan view. As indicated, the circular, substantially flat top panel 16 of the closure cap has a shoulder 18 of somewhat increased thickness, the annular shoulder 18 being connected to the skirt 14. The skirt has a bottom edge 20 that has a diameter larger than that of the top of the skirt, for stacking the cap 12 to overlap with the shoulder of an adjacent cap in a "log" 10 such as shown in FIG. 1. The internal diameter of the skirt at the bottom edge 20 is slightly larger (e.g. about 0.01 inch larger) than the external diameter of the skirt at the shoulder, at the location 22 in FIG. 2.

Figure 5:
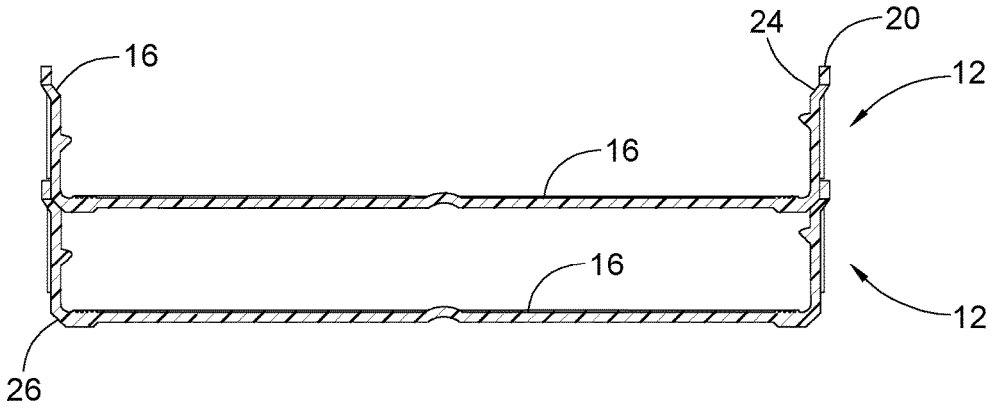
FIG. 5 is a sectional elevation view showing several of the closure caps stacked together.

As shown in the figures, the configuration in the lower portion of the skirt 14 includes a taper 24, i.e. essentially a section of a cone wherein the diameter at the interior of the skirt is reduced over a short vertical distance, such as a distance of about 0.05 to 0.1 inch, on a 110 mm cap. The distance may be about 0.05 to 0.06 inch. This taper is at an oblique angle which may be about 45°, and a bevel 26 of similar angle is provided at the exterior shoulder of the cap as shown, so that this shoulder 26 will nest with and lie against the taper 24 when two caps are stacked together, as shown in FIG. 5.

Figure 4:
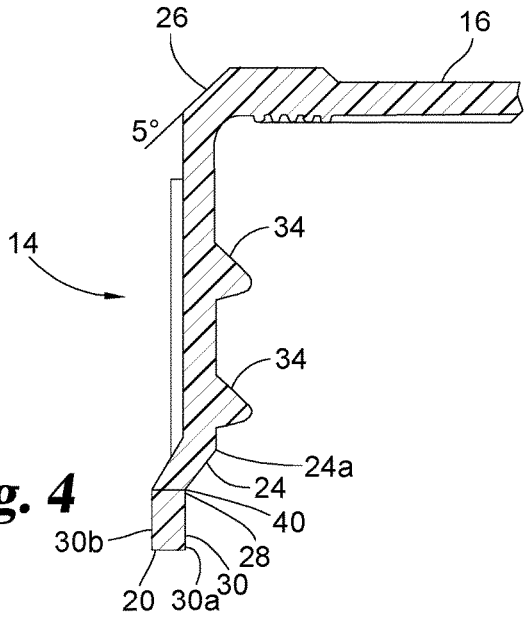
FIG. 4 is a fractional sectional elevation view showing some details of the cap of FIGS. 2 and 3.

Although the bottom edge 28 of the taper 24 could theoretically be precisely at the bottom edge 20 of the skirt, in practice this is difficult to injection mold, and thus a short cylindrical portion 30 preferably is included. This cylindrical section may be about 0.05 to about 0.1 inch, and may be about 0.06 inch. With reference to FIG. 4 and as supported by the other drawings, cylindrical portion 30 has an inner circumference defined by inner surface 30*a* and an outer circumference defined by outer surface 30*b*. This is consistent with the description of lower surface 20 in the form of bottom edge 20 which has an internal diameter and an external diameter, as described above. The entirety of said bottom edge extends from said inner surface 30*a* to said outer surface 30*b* for the entirety of said inner circumference. The substantially conical portion in the form of taper 24 includes an inner surface 24*a* with a bottom edge 28 which contacts the inner surface at junction 40.

FIG. 2 shows the "S" dimension, i.e. the distance from the bottom edge 20 of the skirt to the bottom of the thread start 32. This "S" distance is actually made up of essentially two "S" distances: the distance from the bottom skirt edge 20 to the bottom 28 of the taper; and the distance from the taper up to the bottom of the thread start 32. In this case the first "S" distance is somewhat vague and undefined due to the taper, there being no firm ledge presented to engage against a bottle finish or any other structure. The thread 34 is a single start thread, preferably traversing a minimum angle, such as about 405° (about 1⅛ turns), and follows an industry standard. The closure can include multiple threads if desired, depending on the standard to be followed. The distance from the top edge 36 of the taper 24 up to the bottom of the thread start 32 may be about 0.05 to 0.06 inch or even less if desired.

As one example of dimensions for a 110 mm plastic closure cap, the outer diameter of the cap at the shoulder (just below the bevel 26) is about 4.43 inches, while the inside diameter at the bottom of the skirt 20 is about 4.45 inches. The height of the taper 24, and also of the external shoulder bevel 26, can be about 0.05 to 0.06 inch. The overall height of the closure cap may be about 0.65 inch, while the internal height of the skirt up to the bottom of the shoulder area 18 may be about 0.59 inch. The maximum outside diameter of the cap, at the bottom skirt edge 20, may be about 4.55 inches. Thickness may be about 0.045 inch in the top panel (center) and about 0.044 inch in the skirt wall. The "S" dimension from the bottom of the skirt up to the bottom of the thread start 32 may be about 0.165 inch. The skirt has a slight inward taper as it progresses upwardly, and this may be about 1°.

The closure cap 12 is designed to receive a seal (not shown) up against the underside of its circular top panel, and for this purpose a bead 40 (FIG. 2) extends through an arc of about 180° or more in an upper area of the skirt's interior. This bead, as is known in closure caps, is to retain a loosely assembled seal in the cap until the closure is screwed onto a container and then usually induction heated to secure the seal against the container finish.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A molded plastic stackable cap for threaded receipt by a container, said cap comprising: an upper panel surrounded by an annular shoulder; and an annular skirt extending from said shoulder to a bottom edge, said annular skirt including—an internally threaded side wall; a substantially cylindrical portion which has an inner surface with an inner circumference and an inside diameter and includes said bottom edge, the entirety of said inner surface extending without interruption for the entirety of said inner circumference; and a substantially frusto-conical portion having substantially frusto-conical portion a bottom edge and an inner surface which extends from said side wall to the inner surface of said substantially cylindrical portion with the substantially frusto-conical portion bottom edge at a junction with the inner surface of said substantially cylindrical portion, wherein said shoulder has a substantially frusto-conical shape which is substantially the same as the shape of the substantially frusto-conical portion and wherein a section of said side wall which is adjacent said shoulder has an outside diameter which is smaller than said inside diameter so as to enable stacking by engagement of the substantially frusto-conical portion of one cap with the shoulder of an adjacent stacked cap, wherein said molded plastic stackable cap is free of any cap-nesting ledge positioned on the interior of said annular skirt.

2. The molded plastic stackable cap of claim 1 wherein said internally threaded side wall includes a thread start and a section extending between said thread start and an upper edge of said substantially cylindrical portion.

3. The molded plastic stackable cap of claim 2 wherein said substantially frusto-conical portion and said substantially frusto-conical shape each have a substantially frusto-conical taper of approximately 45 degrees.

4. The molded plastic stackable cap of claim 3 wherein said cap is injection molded.

5. The molded plastic stackable cap of claim 4 wherein said substantially cylindrical portion has an axial height of between approximately 0.05 inches and approximately 0.10 inches.

6. The molded plastic stackable cap of claim 5 wherein said section of said internally-threaded side wall has an axial height of between approximately 0.05 inches and approximately 0.06 inches.

7. The molded plastic stackable cap of claim 1 wherein said substantially frusto-conical portion and said substantially frusto-conical shape each have a substantially frusto-conical taper of approximately 45 degrees.

8. The molded plastic stackable cap of claim 1 wherein said cap is injection molded.

9. The molded plastic stackable cap of claim 1 wherein said substantially cylindrical portion has an axial height of between approximately 0.05 inches and approximately 0.10 inches.

10. The molded plastic stackable cap of claim 2 wherein said section of said internally-threaded side wall has an axial height of between approximately 0.05 inches and approximately 0.06 inches.

11. A molded plastic stackable cap for threaded receipt by a container, said cap comprising: an upper panel surrounded by an annular shoulder; an annular skirt extending from said shoulder to a bottom edge, said annular skirt including: first and second substantially cylindrical portions having respective first and second inside diameters, said first substantially cylindrical portion being adjacent said upper panel and said second substantially cylindrical portion includes said bottom edge, said second substantially cylindrical portion having an inner surface with an inner circumference, the entirety of said inner surface extending without interruption for the entirety of said inner circumference; a thread extending along an inside surface of said first substantially cylindrical portion; and a substantially frusto-conical portion, said substantially frusto-conical portion having an upper end terminating at said first substantially cylindrical portion and a lower end terminating at said second substantially cylindrical portion such that said upper end and said lower end have respective inside diameters equal to said first and second inside diameters; and wherein said shoulder has a substantially frusto-conical shape which is substantially the same as the shape of the substantially frusto-conical portion and wherein a section of said first substantially cylindrical portion which is adjacent said shoulder has an outside diameter which is smaller than said second inside diameter so as to enable stacking by engagement of the substantially frusto-conical portion of one cap with the shoulder of an adjacent stacked cap, wherein said molded plastic stackable cap is free of any cap-nesting ledge positioned on the interior of said annular skirt.

12. The molded plastic stackable cap of claim 11 wherein said substantially frusto-conical portion and said substantially frusto-conical shape each have a substantially frusto-conical taper of approximately 45 degrees.

13. The molded plastic stackable cap of claim 11 wherein said engagement representing a singular contact location between said one cap and said adjacent stacked cap.

14. A stack of closure caps for handling and storing during a curing period to lessen a risk of warpage, said stack comprising: a plurality of stackable, injection molded closure caps wherein each closure cap of said plurality includes: an upper panel surrounded by a shoulder; and an annular skirt extending from said shoulder to a bottom edge, said annular skirt including an internally threaded side wall, a generally cylindrical portion which has an inside surface and includes said bottom edge, and an intermediate portion having a substantially frusto-conical surface extending between an inner surface of said side wall and said inside surface, wherein a section of said side wall which is adjacent said shoulder is constructed with a size and shape which is compatible with said inside surface so as to enable stacking by engagement of the intermediate portion of one cap and the shoulder of an adjacent stacked cap, wherein each injection molded closure cap of said plurality is free of any cap-nesting ledge positioned on the interior of its annular skirt, said inside surface having an inner circumference, the entirety of said inside surface extending without interruption and extending for the entirety of said inner circumference.

15. The stack of closure caps of claim 14 wherein each closure cap of said plurality having an overall height and an outside diameter wherein said overall height is less than 20 percent of the outside diameter.

* * * * *